United States Patent [19]

Schmitz

[11] Patent Number: 4,845,970

[45] Date of Patent: Jul. 11, 1989

[54] PROCESS AND APPARATUS FOR REGULATING THE SYNCHRONIZATION OF A PAIR OF ROLLS

[75] Inventor: Fernand Schmitz, Lorentzweiler, Luxembourg

[73] Assignee: Arbed S.A., Luxembourg

[21] Appl. No.: 893,683

[22] Filed: Aug. 6, 1986

[30] Foreign Application Priority Data

Aug. 16, 1985 [LU] Luxembourg ..... 86 043

[51] Int. Cl.[4] ..... B21B 37/00; B21B 31/20; B41F 13/24

[52] U.S. Cl. ..... 72/21; 72/35; 72/37; 72/180; 72/195; 72/237; 101/248

[58] Field of Search ..... 72/243, 245, 247, 237, 72/241, 199, 20, 21, 195, 198, 196, 197, 180, 35, 103, 104, 37; 101/248, 6, 23, 24, 25

[56] References Cited

U.S. PATENT DOCUMENTS

| | | | |
|---|---|---|---|
| 1,860,931 | 5/1932 | Keller | 72/243 |
| 2,075,574 | 3/1937 | Dahlstrom | 72/247 X |
| 2,639,660 | 5/1953 | Sunderhauf et al. | 72/196 X |
| 3,088,399 | 5/1963 | Broderick | 101/248 X |
| 4,453,393 | 6/1984 | Hino et al. | 72/243 |

FOREIGN PATENT DOCUMENTS

| | | | |
|---|---|---|---|
| 0096563 | 12/1983 | European Pat. Off. | 101/248 |
| 0059512 | 5/1981 | Japan | 72/243 |
| 0130358 | 10/1981 | Japan | 101/248 |
| 0004307 | 1/1982 | Japan | 72/243 |
| 0116913 | 7/1983 | Japan | 72/243 |
| 0123665 | 7/1984 | Japan | 101/248 |

*Primary Examiner*—Robert L. Spruill
*Assistant Examiner*—Steven B. Kutz
*Attorney, Agent, or Firm*—Fishman, Dionne & Cantor

[57] ABSTRACT

Two rolls are supported laterally in bearings in two pairs of side-by-side members with the members being supported by a frame. Adjustment of synchronization and registration is accomplished by adjusting the relative positions of the side-by-side members in or against the rolling direction. The relative positions of the rolls can be adjusted by use of notches engraved in the ends of the rolls; and can be continuously monitored with the aid of a stroboscope light. Magnetic signal devices and other sensors are also suitable for monitoring. Continuous adjustment of roll position is accomplished through low-pitch screws or through hydraulic or electric positioning motors.

9 Claims, 2 Drawing Sheets

PROCESS AND APPARATUS FOR REGULATING THE SYNCHRONIZATION OF A PAIR OF ROLLS

BACKGROUND OF THE INVENTION

This invention relates to a process and apparatus for regulating the synchronization or registration of a pair of rolls.

An interesting development in reinforced concrete design has led to reinforcing rods which have helical ribs on two opposing sides thereof. These helical ribs result in a thread. Such rods are connected to each other by means of sleeves with corresponding internal threading. The use of such threads results in material savings by elminating extra rod lengths. It will be appreciated that relatively greater rod lengths are unavoidable with conventionally used rod interconnection techniques of hooking or overlapping and welding.

Unfortunately, such material savings are partly offset by certain known difficulties which occur when rolling the thread into the rods. These difficulties necessitate synchronization of the two rolls. It will be appreciated that synchronization is not imperative or necessary when rolling rods without the type of helical threads described hereinabove.

Although a synchronous drive (which will ensure the necessary synchronization) can be designed into existing rolls without many problems, such a design entails high costs, especially if it involves changes to existing drives; and if it turns out that such a synchronous drive cannot readily be built into all drives (e.g. vertical frmes), and that additional costs are incurred for the purchase of more adaptable drives.

SUMMARY OF THE INVENTION

The above-discussed and other problems and deficiencies of the prior art are overcome or alleviated by the method and apparatus for regulating the synchronization of a pair of rolls of the present invention. In accordance with the present invention, a process and an apparatus which guarantee the synchronous running of a pair of rolls for the purpose of forming flawless thread ribs on concrete reinforcing rods is provided without requiring a specially designed synchronous drive and without imposing an additional load on the roll drive. The present invention also permits the desired synchronism on any roll stand available in a rolling mill without making costly changes to the drive system. An additional feature of the present invention is that the process makes it possible not only to detect departures of roll travel from the required conditions during production, but also to correct it easily without interrupting production.

The process and apparatus of the present invention regulates the synchronization or registration of a pair of rolls, in which the rolls are laterally supported in bearings in two pairs of side-by-side or laterally spaced members. The laterally spaced members are supported by a frame. Significantly, the rolls are synchronized by adjusting the relative positions of the side-by-side members in or against the rolling direction. In the apparatus of the present invention, the side-by-side members of at least one of the rolls are supported by the frame through means which permit continuous adjustment of their horizontal location.

Surprisingly, the problems of the prior art are overcome using the present invention rather than using a synchronous drive (in which the desired synchronization or registration can be achieved only after rolling and checking at least one rod, by adjusting one of the two rolls in or against the direction of rotation at the synchronous drive). It is also extremely difficult (or even impossible) to readjust such a synchronous drive during rolling, so that production must be interrupted for a fairly long time for every adjustment or readjustment of synchronism. Even this readjustment, however, is extraordinarily simple to do, if one uses the process of the present invention. For exact control of synchronism before and during rolling, it suffices to mark the desired positions of the two rolls by notches and then to check their positions with the aid of a stroboscope light or other monitoring device.

The above-discussed and other features and advantages of the present invention will be appreciated and understood by those skilled in the art from the following detailed description and drawings.

BRIEF DESCRIPTION OF THE DRAWINGS

Referring now to the drawings.

DESCRIPTION OF THE PREFERRED EMBODIMENT

Figure 1:
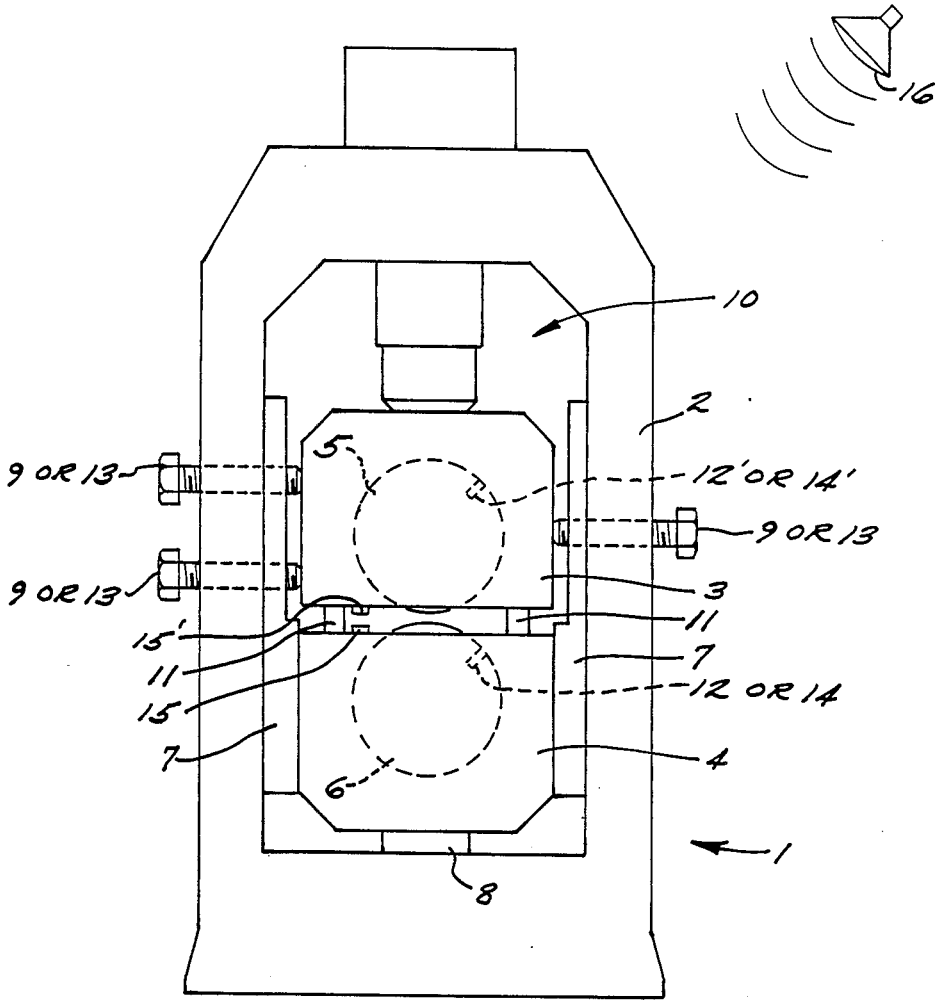
FIG. 1 is a schematic side view of an apparatus for adjusting synchronism in accordance with the present invention.

Referring to FIG. 1, a portion ($\frac{1}{2}$) of a roll stand is shown generally at 1. It will be appreciated that the opposed portion (other $\frac{1}{2}$) of roll stand 1 is identical to that portion of roll stand 1 shown in FIG. 1. Roll stand 1 comprises a frame 2 which contains an upper member 3 and a lower member 4. An upper roll 5 and a lower roll 6 are mounted in rotary bearings in members 3 and 4. In order to simplify the drawing, the drive system and the axial adjustment system of the rolls are not shown in FIG. 1. The location of lower member 4 is determined in the horizontal direction by wear plate 7, and in the vertical direction by plate 8. The vertical location of upper member 3 is determined by two hydraulic cylinders 11 located in the lower member 4 and by an adjustment screw 10, supported by frame 1. Cylinders 5 and 6 are pressurized through holes in member 4. The horizontal location of member 3 is continuously adjustable. In the embodiment shown, this adjustability is accomplished by means of three adjustment screws 9 with small pitch, two of which are on the exit side of member 3, with one screw 9 being on the opposite side thereof. Thus, a total of six screws in the frame not only permit a horizontal adjustment at 90 degrees to the rolling direction, but also permit easy adjustment of the upper roll 5 relative to the lower roll 6 in order to achieve parallelism of the roll axes.

In order to roll the desired helical ribs into the opposite sides of the concrete-reinforcing rods, a corresponding number of ribs (not shown) are milled into the lower and upper rolls.

For drive reasons, it has been found particularly advantageous to choose a roll diameter such that an odd number of ribs will be milled. The beneficial result of this is that the horizontal adjustment of the upper roll "forward" (i.e. in rolling direction) or "backward" (i.e. against the rolling direction) amounts to a maximum of one quater (1/4) of the pitch between adjacent ribs. A larger adjustment is avoided by rotating one of the two rolls 180 degrees and then adjusting horizontally. The largest required horizontal adjustment is therefore small and no undesirable bending moments are imposed on the product by the rolling process. The procedure in accordance with this invention is as follows:

Initially, after a change of profile, the horizontal location of both upper members 3 are adjusted approximately by means of screws 9. By rolling the first rods or by means of a test piece cut off by hand, a fine adjustment of the horizontal position of the members is then performed until the upper and lower ribs show optimal relative positions, which will later permit problem-free screwing-on of the couplings. The adjustment of the upper roll in relation to the lower roll can be done either "forward" or "backward". The maximum adjustment (i.e. the maximum distance between the two vertical planes containing the axes of the upper and lower rolls) amounts to one fourth of the distance between neighboring ribs, measured in the direction of the rod axis. That much free adjustment distance should be provided between the upper members 3 and the frame 2 in both directions. Experience has shown that, once the positions of the upper members have been optimally adjusted, readjustments are not frequently required.

If continuous monitoring is desired, notches 12 and 12' can be engraved in the end surfaces of the lower and upper rolls. Since the rotational speed of a roll is approximately 700 rpm, the relative positions of the notches 12 and 12' can easily be monitored during rolling with the aid of a stroboscope light. The presence of notches 12 and 12', which mark the relative positions of rib valleys and ribs on the upper and lower rolls, also greatly simplifies adjustment after size changes; synchronism is produced by exactly opposing two notches 12 and 12' on the rolls.

Figure 2:
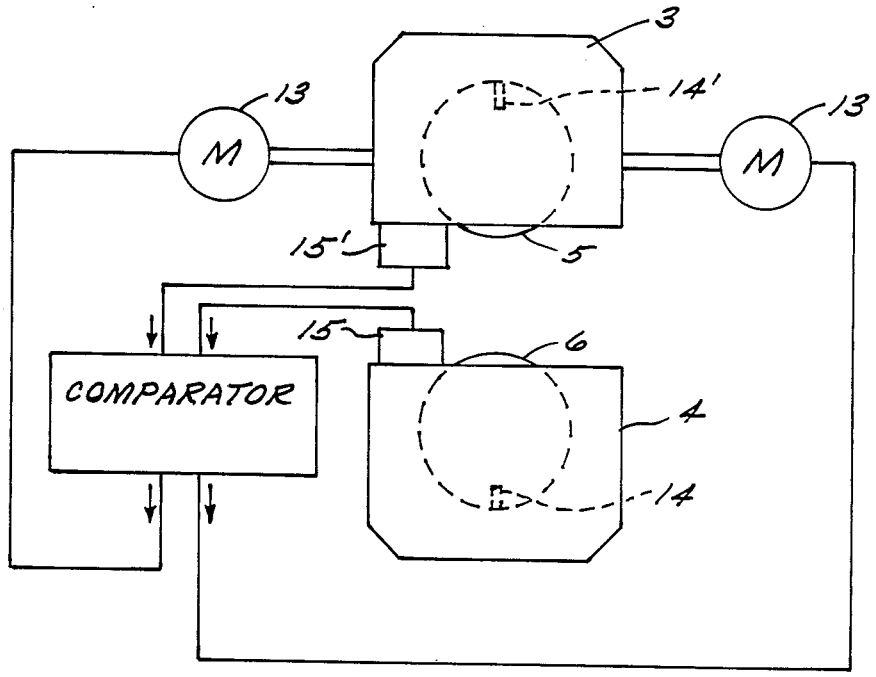
FIG. 2 is a schematic representation of a control circuit used in conjunction with the present invention.

In an alternative embodiment shown in FIG. 2, rather than screws 9, hydraulic or electric positioning motors 13 can be used. In this case, synchronism is monitored with the aid of electromagnetic sensors which continuously readjust the horizontal location of the upper members. For this purpose, one can, e.g. install permanent magnets 14 and 14' at the roll ends and Hall sensors 15 and 15' on the frame. The signals provided by the sensors are compared with stored data which reflect synchronism. When a different signal results, the motors are altered such that synchronism is restored.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. In an improved process for regulating the synchronism of a pair of rolls in a frame when producing rolled stocked having a regular engraved pattern thereon, the frame having a central vertical plane through the length of the rolls wherein the rolls are laterally supported with respect to the central vertical plane in bearings in spaced members, the spaced members being laterally supported by the frame along the central vertical plane, the improvement including the steps of:

feeding stock between said pair of laterally spaced rolls supported in said laterally spaced members in a first rolling direction transverse to the central vertical plane of the frame;

adjusting the relative positions of the laterally spaced members along a horizontal plane parallel to the rolling direction to require synchronous movement of said rolls wherein said stock being fed between said rolls will be provided with a regular engraved pattern thereon;

continuously monitoring synchronism by means of signal providing means fastened to the rolls and sensors fastened to the frame;

comparing a first signal from said signal providing means to a second signal which represents synchronism; and regulating the relative positions of the rolls in accordance with the difference in the first and second signals.

2. The process of claim 1 wherein:

said rolls are arranged one above another in a horizontal stand or side-by-side in a vertical stand.

3. The process of claim 1 including the step of:

adjusting the relative positions of the rolls with the aid of notches provided at the ends of the rolls.

4. The process of claim 3 including the steps of:

continuously monitoring the synchronism of the rolls by means of a stroboscope lamp, in conjunction with said notches in the rolls ends; and adjusting the laterally spaced members relative to each other in order to restore synchronism when a deviation from synchronism is detected.

5. An apparatus for regulating the synchronization of a pair of rolls when producing rolled stock having a regular engraved pattern thereon comprising:

a pair of spaced rolls adapted for receiving stock fed therebetween in a first rolling direction;

a frame having a central vertical plane along the length of the rolls, said rolls being laterally spaced along said plane, said first rolling direction being transverse to said central vertical plane;

at least two spaced members, said spaced members being laterally supported with respect to the central vertical plane in said frame, said rolls being laterally supported in bearings in said members;

at least one of said rolls being supported in said frame by adjustment means which permit continuous adjustment of said at least one roll along a horizontal plane parallel to the first rolling direction wherein synchronuous movement of said rolls is regulated and wherein stock being fed between said rolls will be provided with a regular engraved pattern thereon;

said adjustment means comprising positioning motors;

magnetic signal providing means fastened to said rolls; and sensors fastened to said frame wherein said sensors communicate with an electrical comparison device which contains data signifying synchronism and wherein said comparison device, in response to a difference signal from said signal providing means, influence the positioning motors in such a way that synchronism is restored.

6. The apparatus of claim 5 wherein:

said adjustment means comprise threaded fastening elements.

7. The apparatus of claim 5 wherein said rolls have ends and including:

notches provided at said ends of said rolls; and means for monitoring the synchronism of said rolls by detecting the relative position of said notches on said rolls.

8. The apparatus of claim 7 wherein:

said means for monitoring comprise stroboscope lamp means.

9. An apparatus for regulating the synchronization of a pair of rolls when producing rolled stock having a regular engraved pattern thereon comprising:

a pair of spaced rolls adapted for receiving stock fed therebetween in a first rolling direction;

a frame having a central vertical plane along the length of the rolls, said rolls being laterally spaced along said plane, said first rolling direction being transverse to said central vertical plane;

at least two spaced members, said spaced members being laterally supported with respect to the central vertical plane in said frame, said rolls being laterally supported in bearings in said members;

at least one of said rolls being supported in said frame by adjustment means which permit continuous adjustment of said at least one roll along a horizontal plane parallel to the first rolling direction wherein synchronous movement of said rolls is regulated and wherein stock being fed between said rolls will be provided with a regular engraved pattern thereon;

means for continuously monitoring synchronism by means of signal providing means fastened to the rolls and sensors fastened to the frame;

means for comparing a first signal from said signal providing means to a second signal which represents synchronism; and means for regulating the relative positions of the rolls in accordance with the difference in the first and second signals.

* * * * *